US009820505B2

(12) United States Patent
Gouinguene et al.

(10) Patent No.: US 9,820,505 B2
(45) Date of Patent: Nov. 21, 2017

(54) TOBACCO COMPOSITION COMPRISING TOBACCO FLOWER

(71) Applicant: Philip Morris Products S.A., Neuchatel (CH)

(72) Inventors: Sandrine Gouinguene, Neuchatel (CH); Gregor Bindler, Chabrey (CH); Dzeti Zait, Neuchatel (CH); Edric Santos, Tanauan (PH)

(73) Assignee: Philips Morris Products S.A., Neuchatel (CH)

( * ) Notice: Subject to any disclaimer, the term of this patent is extended or adjusted under 35 U.S.C. 154(b) by 211 days.

(21) Appl. No.: 14/423,728

(22) PCT Filed: Aug. 27, 2013

(86) PCT No.: PCT/IB2013/058026

§ 371 (c)(1),
(2) Date: Feb. 25, 2015

(87) PCT Pub. No.: WO2014/033629

PCT Pub. Date: Mar. 6, 2014

(65) Prior Publication Data

US 2017/0042216 A1 Feb. 16, 2017

Related U.S. Application Data

(60) Provisional application No. 61/693,906, filed on Aug. 28, 2012.

(30) Foreign Application Priority Data

Aug. 28, 2012 (EP) ..... 12182086

(51) Int. Cl.

| | |
|---|---|
| ***A24B 15/18*** | (2006.01) |
| ***A24B 15/12*** | (2006.01) |
| ***A24B 15/30*** | (2006.01) |

(52) U.S. Cl.

CPC ..... *A24B 15/303* (2013.01); *A24B 15/12* (2013.01); *A24B 15/186* (2013.01); *A24B 15/30* (2013.01)

(58) Field of Classification Search

None

See application file for complete search history.

(56) References Cited

U.S. PATENT DOCUMENTS

| | | | |
|---|---|---|---|
| 3,894,544 | A | 7/1975 | Egri |
| 5,598,868 | A | 2/1997 | Jakob et al. |
| 5,724,998 | A | 3/1998 | Gellatly et al. |
| 6,216,706 | B1 | 4/2001 | Kumar et al. |
| 2013/0160779 | A1 | 6/2013 | Chida et al. |

FOREIGN PATENT DOCUMENTS

| | | | |
|---|---|---|---|
| EP | 0 419 974 | A1 | 4/1991 |
| GB | 983928 | | 2/1965 |
| GB | 2020538 | A | 11/1979 |
| JP | 03-175968 | A | 7/1991 |
| JP | 06-046817 | A | 2/1994 |
| WO | WO 2011/088171 | A2 | 7/2011 |
| WO | WO 2011/088171 | A3 | 10/2011 |
| WO | WO 2012/023515 | A1 | 2/2012 |

OTHER PUBLICATIONS

International Preliminary Report on Patentability issued by the International Bureau of WIPO as the International Searching Authority in PCT/IB2013/058026, dated Mar. 12, 2015; 8 pgs.

International Search Report and Written Opinion issued by the European Patent Office as the International Searching Authority in PCT/IB2013/028026, dated Jan. 15, 2014; 11 pgs.

Extended European Search Report issued by the European Patent Office in EP Application No. 12182086.4, dated Mar. 6, 2013; 6 pgs.

Senkus et al., "Use of Tobacco Flowering Tops as a Flavor Enhancer and Filler for Reconstituted Tobacco," RJ Reynolds, Nov. 30, 1971. Retrieved from the Internet:<URL:http://industrydocuments.library.ucsf.edu/tobacco/docs/mhcy0093>; 1 pgs.

Galina, "Tobacco Flowers as a Source of Flavor (Report No. RD 192/80) Leaf Surface Gums (Report No. RD 191/80)," RJ Reynolds,. Oct. 21, 1980, Retrieved from the Internet:<URL:http://industrydocuments.library.ucsf.edu/tobacco/docs/hpjg020>; 19 pgs.

Bevan, "Notes on Extraction of Basma Flowers from Brazil," Jun. 4, 1981, Retrieved from the Internet:<URL:http://industrydocuments.library.ucsf.edu/tobacco/docs/xyg0210>; 2 pgs.

*Primary Examiner* — Michael H Wilson
*Assistant Examiner* — Katherine Will
(74) *Attorney, Agent, or Firm* — Mueting, Raasch & Gebhardt, P.A.

(57) ABSTRACT

A tobacco blend includes cut tobacco and a sheet material including tobacco and one or more flowers of *Nicotiana* species plant. The sheet material has at least 1 weight percent of the one or more flowers of *Nicotiana* species plant based on the total weight of the tobacco blend. The one or more flowers of *Nicotiana* species plant are disposed on an outer surface of the sheet material.

21 Claims, No Drawings

TOBACCO COMPOSITION COMPRISING TOBACCO FLOWER

This application is the §371 U.S. National Stage of International Application No. PCT/IB2013/058026, filed 27 Aug. 2013, which claims the benefit of U.S. Provisional Application No. 61/693,906, filed 28 Aug. 2012, and European Application No. 12182086.4, filed 28 Aug. 2012, which are incorporated by reference herein in their entireties.

The present disclosure relates to a tobacco composition comprising tobacco flower. The composition can be a tobacco blend comprising a tobacco sheet material having particulate tobacco flower placed on an outer surface of the tobacco sheet material. The tobacco flower imparts flavour to the tobacco composition.

Combustible smoking articles, such as cigarettes, have shredded tobacco surrounded by a paper wrapper forming a tobacco rod. A cigarette is employed by a smoker by lighting one end thereof and burning the shredded tobacco rod. The smoker then receives mainstream smoke into their mouth by drawing on the opposite end or filter end of the cigarette. The shredded tobacco can be a single type of tobacco or a blend of two or more types of tobacco depending of the brand of cigarette.

Other smoking articles have tobacco which is heated rather than combusted. In heated smoking articles, an aerosol Is generated by heating a flavour generating substrate, such as tobacco. Known heated smoking articles include, for example, electrically heated smoking articles and smoking articles, in which an aerosol is generated by the transfer of heat from a combustible heat source to a physically separate aerosol forming material. During smoking, volatile compounds are released from the aerosol forming substrate by heat transfer from the heat source and entrained in air drawn through the smoking article. As the released compounds cool they condense to form an aerosol that is inhaled by the consumer.

Various treatment methods and additives have been proposed for altering the overall character or taste of the tobacco utilized in smoking articles. For example, additives or treatment processes have been utilized to alter the chemistry or sensory properties of the tobacco or mainstream smoke generated by the tobacco.

The sensory attributes of cigarette smoke can be modified by incorporating flavouring materials into various components of the cigarette. Exemplary flavouring additives include natural or synthetic menthol, peppermint, spearmint, coffee, tea, spices (such as cinnamon, clove and ginger), cocoa, vanilla, fruit flavours, chocolate, eucalyptus, geranium, eugenol, agave, juniper, anethole and linalool. While these flavourings achieve the desired effect, they are not generally considered to be a natural tobacco-originating products. Some tobacco products or smoking articles strive to achieve an all-natural tobacco product.

It would be desirable to provide an all-natural tobacco or tobacco blend for smoking articles that have enhanced flavour or taste. It would be desirable to provide a natural tobacco flavouring that can be blended during a tobacco preparation process to achieve a more uniform, harmonious and smoother taste. It would also be desirable to blend natural tobacco flavouring with particulate tobacco to form a sheet of with uniform taste attributes when utilized in a smoking article.

According to the current disclosure there is provided a sheet of tobacco material comprising a flower of *Nicotiana* species plant that is disposed on the outer surface of the sheet of tobacco material and can optionally also be blended with or dispersed within the sheet of tobacco material. The sheet of tobacco composition can be formed with particulate tobacco or by blending the flower of *Nicotiana* species plant in powder or particulate form with the particulate tobacco. The tobacco or particulate blend is then formed into a sheet of tobacco material. The flower of *Nicotiana* species plant can be disposed on the already formed sheet material. This sheet material that includes flower of *Nicotiana* species plant that has been placed on its outer surface can optionally include flower of *Nicotiana* species plant disposed within the sheet material. The sheet material can then be blended with cut tobacco to form a tobacco blend. The resulting sheet of tobacco material can include at least 5 weight percent or about 5 to about 40 weight percent flower of *Nicotiana* species plant, based on the weight of the sheet material. This sheet of tobacco may be substantially free of flavour that is non-tobacco or non-*Nicotiana* species material.

The tobacco composition and the methods according to the present disclosure provide an effective way to improve the tobacco sensory properties by placing the one or more flowers of *Nicotiana* species plant on the outer surface of the sheet material and optionally by blending the one or more flowers of *Nicotiana* species plant with tobacco to form the sheet material. Tobacco flower or flower of *Nicotiana* species plant provides an all-natural tobacco or *Nicotiana* species flavouring to the tobacco and resulting smoking article. Particulate tobacco, which can optionally be blended with one or more flowers of *Nicotiana* species plant in particulate or powder form, can be used to form a tobacco particulate blend. This particulate blend can then be utilized to form sheet material. Sheet material formed with this blend or composition provide a uniform tobacco product throughout the sheet of tobacco composition. Thus, the sheet of tobacco composition provides a consistent, uniform and smoother taste. Flower of *Nicotiana* species plant is also disposed on the surface of the formed sheet material to enhance the flavour charactistics and available aromas imparted with the flower of *Nicotiana* species plant.

The sheet material is cut or subdivided into smaller pieces and blended with tobacco to form a tobacco blend and to provide a product suitable for use in a smoking article or in a smokeless tobacco product.

The term "smoking article" as used herein includes cigarettes, cigars, cigarillos and other articles in which a smoking composition, such as a tobacco composition, is lit and combusted to produce smoke. The term "smoking article" also includes those in which the smoking composition is not combusted such as but not limited to smoking articles that heat the smoking composition directly or indirectly, or smoking articles that neither combust nor heat the smoking composition, but rather use air flow or a chemical reaction to deliver nicotine, flavour compound or other materials from the tobacco.

The phrase "smokeless tobacco product" includes tobacco products that are inserted into the mouth of the user. An example of a smokeless tobacco product is "snuff", commonly referred to as "snus".

As used herein, the term "smoke" is used to describe an aerosol produced by a smoking article. An aerosol produced by a smoking article may be, for example, smoke produced by combustible smoking articles, such as cigarettes, or aerosols produced by non-combustible smoking articles, such as heated smoking articles or non-heated smoking articles.

The term "tobacco" includes tobacco leaf, tobacco manufacturing by-products such as tobacco stems and tobacco dust, and mixtures thereof.

The sheet material or layer comprising tobacco can be formed by any suitable method. Common methods include blending to form blended leaf tobacco or reconstituting to form reconstituted tobacco.

"Blended leaf tobacco" refers to a sheet cast from a paste made with tobacco dust collected from tobacco stemming and finely milled leaf stem.

"Reconstituted tobacco" refers to a tobacco substrate that has been formed from tobacco by-products such as tobacco dust and tobacco fragments from tobacco processing or handling, for example. This tobacco dust may be created by tobacco breakage during shipping and manufacturing, leaf lamina, stems and other tobacco by-products that are finely ground may be mixed with a binder to agglomerate the particulate tobacco. The agglomerated tobacco may include other additives, including but not limited to, aerosol-formers (such as glycerine or propylene glycol), plasticizers, humectants, and non-tobacco fibers, fillers, aqueous and non-aqueous solvents and combinations thereof. The agglomerated tobacco can be cast, extruded, or rolled. A number of reconstitution processes for producing homogenized tobacco materials are known. These include, but are not limited to: paper-making processes of the type described in, for example, U.S. Pat. No. 5,724,998; casting processes of the type described in, for example, U.S. Pat. No. 5,724,998; dough reconstitution processes of the type described in, for example, U.S. Pat. No. 3,894,544; and extrusion processes of the type described in, for example, in GB 983,928.

The phrase "reconstituted tobacco sheet" denotes a sheet that comprises reconstituted tobacco or blended leaf tobacco.

The terms "flower" and "flower of *Nicotiana* species" includes both a single species of *Nicotiana* and two or more species of *Nicotiana* forming a flower blend. The term "flower" refers to the characteristic reproductive structure of the plant and includes the whole flower or a portion thereof. A tobacco flower is the characteristic reproductive structure of the plant of the *Nicotiana* genus. The manner by which the flower is harvested from the plant can vary. Harvesting of flowers has been referred to as "picking". As such, the flower is removed from the rest of the plant by cutting or breaking the stem or pedicle that connects the flower to the rest of the plant. Various parts or portions of the flower can be employed. For example, the entire or substantially the entire flower (the whole flower) can be employed. Alternatively, various parts or portions of the flower can be employed. For example, the petal, corolla, sepal, receptacle, anther, filament, stigma, stamen, style, pistil, pedicel, ovary or combinations thereof can be isolated and employed.

The phrase "tobacco composition" refers to a mixture comprising tobacco with a flower of *Nicotiana* genus plant. As described above, the "flower" includes both a single species from the *Nicotiana* genus and two or more species from the *Nicotiana* genus forming a flower blend. The harvested flower is preferably provided in particulate form or powder form. In many embodiments, the flower is in particulate form and is placed on an outer surface of the sheet material of tobacco. The particulate flower material is placed on the outer surface of the sheet material of tobacco following the formation of the sheet material of tobacco. In some embodiments, tobacco and flower are in particulate form and are also blended together to form a tobacco composition having a homogenous mixture. This homogenous mixture, with or without flower diposed within the composition, can then be formed into a sheet and one or more flowers are disposed on the outer surface of the sheet material of tobacco. This provides a uniform composition blend throughout and on top of the sheet material. Thus, the sheet material can provides a tobacco product having a consistent, uniform and smoother taste.

The amount of flower of *Nicotiana* species plant present in the tobacco sheet varies depending on the final product specification. The tobacco sheet includes at least about 5 weight percent flower of *Nicotiana* species plant. The tobacco sheet includes less than about 50 weight percent flower of *Nicotiana* species plant. In many embodiments, the tobacco sheet includes flower of *Nicotiana* species plant in a range from about 5 weight percent to about 50 weight percent, or about 5 weight percent to about 40 weight percent. In many embodiments the tobacco sheet includes at least about 10 weight percent, or 15 weight percent, or 20 weight percent flower of *Nicotiana* species plant. All of the percentages in this paragraph are based on the total weight of the tobacco sheet.

In many embodiments, the flower can be utilized and blended with or added to the tobacco composition without alteration. In other embodiments, the flower can be divided into a plurality of particles and then blended with or added to the tobacco composition. In many embodiments the flower is dried, such as freeze-dried. In many embodiments, the flower can be blended with the tobacco composition without alteration or dried and divided into a plurality of particles and then blended with or added to the tobacco composition. The flower in particulate form can have any useful size (largest lateral dimension). In many embodiments the flower particulate has an average size that is similar to or substantially the same as the tobacco particulate average size. In many embodiments the flower particulate has an average size in a range from about 1 to 1000 micrometers or from about 10 to 500 micrometers or from about 25 to 200 micrometers.

The flower of *Nicotiana* species plant includes both a single species of *Nicotiana* and two or more species of *Nicotiana* forming a flower blend. Specific *Nicotiana* species plants (useful for flower or leaf) includes: *glauca; paniculata; knightiana; solanifolia; benavidesii; cordifolia; raimondii; thyrsiflora; rustica; tomentosa; tomentosiformis; otophora; kawakamii; glutinosa; tabacum; undulate; arentsii; wigandiokles; trigonophylla; palmeri; sylvestris; langsciorffii; alata; forgetiana; bonariensis; longiflora; plumbaginifolia; repanda; stocktonii; nesophila; noctiflora; petunioides; acaulis; ameghinoi; acuminate; pauciflora; attenuate; miersii; corymbosa; linearis; spegazzinii; bigelovii; clevelandii; nudicaulis; benthamiana; umbratica; cavicola; debneyi; gossei; amplexicaulis; maritime; velutina; hesperis; occidentalis; simulans; megalosiphon; rotundifolia; excelsior; suaveolens; ingulba; exigua; goodspeedii; fragrans; Africana; stenocarpa; wuttkei; setchellii*; and *purpurea*. In many embodiments, the *Nicotiana* species plants includes varieties such as: Red Russian, K326, Laksoon *N. rustica*, Kasturi, Kasturi Asep, Tombak, Basma Zihna, Basma Drama, or TI1112.

Analytical testing of various *Nicotiana* species plant flowers indicate that the plant flowers of a number of specific *Nicotiana* varieties may be particularly useful to impart flavour to the tobacco composition. These include, for example, Kasturi, K326, Red Russian, Laksoon *N. rustica*, and *N. purpurea*.

The sheet material of tobacco can be referred to as a reconstituted sheet material and formed using particulate tobacco (for example, reconstituted tobacco) or a tobacco and flower particulate blend, a humectant and an aqueous solvent to form the tobacco composition. This tobacco composition is then casted, extruded, rolled or pressed to form a sheet material from the tobacco composition. The sheet of tobacco can be formed utilizing a wet process, where tobacco fines are used to make a paper-like material; or a cast leaf process, where tobacco fines are mixed together with a binder material and cast onto a moving belt to form a sheet. As described above, the "flower" includes both a single species of *Nicotiana* and two or more species of *Nicotiana* forming a flower blend. The tobacco composition can be cast, extruded, pressed or rolled to form the sheet material as described above.

In some embodiments the sheet material is formed using a tobacco composition that is prepared by providing a particulate tobacco, and optionally a flower of *Nicotiana* species plant in particulate form, to form a particulate blend and then combining water and glycerine to the particulate mix to form the tobacco composition. This tobacco composition can then be cast, extruded, or rolled to form the sheet material as described above. Then one or more flowers of *Nicotiana* species plant is disposed or placed on an outer or top surface of the sheet material.

In some embodiments the sheet is formed using a tobacco composition that is prepared by mixing water and glycerine and a flower of *Nicotiana* species plant in particulate form to form a flower mix and then blending particulate tobacco with the flower mix to form the tobacco composition. This tobacco composition can be cast, extruded, rolled or pressed to form the sheet material as described above. Then one or more flowers of *Nicotiana* species plant is disposed or placed on an outer or top surface of the sheet material.

In many embodiments, the flower of *Nicotiana* species plant is placed on or disposed on or "top loaded" onto the tobacco sheet. In these embodiments, the tobacco may or may not also have flower of *Nicotiana* species plant dispersed within the tobacco sheet. The flower of *Nicotiana* species plant can be disposed onto a surface of the tobacco sheet and bound to the surface of the tobacco sheet, for example via a binder material forming the tobacco sheet or sheet material. The flower of *Nicotiana* species plant can be placed or disposed on the surface of the tobacco sheet as a dry particulate material or sprayed onto the surface of the tobacco sheet with a liquid carrier material such as water or casing material.

Disposing the flower of *Nicotiana* species plant on the surface of the tobacco sheet can provide an advantage that the aroma and flavour imparted by the flower of *Nicotiana* species plant is more readily available when combusted or consumed as compared to the same flower of *Nicotiana* species plant being dispersed within the sheet material. In some embodiments the flower of *Nicotiana* species plant is applied in a specific or particular pattern to the surface of the tobacco sheet.

The sheet material can have any useful tobacco and flower content. The sheet of the composition has at least about 1 weight percent, or at least 3 weight percent, or at least 5 weight percent flower of *Nicotiana* species plant. The sheet of the tobacco composition includes less than about 50 weight percent flower of *Nicotiana* species plant. In many embodiments, the sheet of the tobacco composition includes flower of *Nicotiana* species plant in a range from about 1 weight percent to about 50 weight percent, or about 5 weight percent to about 40 weight percent. In many embodiments the sheet of the tobacco composition includes at least about 10 weight percent, or about 15 weight percent, or about 20 weight percent flower of *Nicotiana* species plant. All of the percentages in this paragraph are based on the total weight of the tobacco blend in which the sheet is used.

In some embodiments the sheet of the tobacco composition has about 50 to 65 weight percent particulate tobacco, based on the total weight of the tobacco composition, about 5 to 20 weight percent flower of *Nicotiana* species plant, about 5 to 20 weight percent aqueous solvent, and about 15 to 25 weight percent humectant. In these embodiments the sheet of the tobacco composition can have about 55 to 65 weight percent particulate tobacco, about 7 to 16 weight percent flower of *Nicotiana* species plant, about 5 to 15 weight percent aqueous solvent, and about 15 to 25 weight percent humectant.

In other embodiments the sheet of the tobacco composition has about 25 to 40 weight percent particulate tobacco, based on the total weight of the tobacco composition, about 25 to 40 weight percent flower of *Nicotiana* species plant, about 5 to 20 weight percent aqueous solvent, and about 15 to 25 weight percent humectant. In these embodiments the sheet of the tobacco composition can have about 28 to 38 weight percent particulate tobacco, about 28 to 38 weight percent flower of *Nicotiana* species plant, about 5 to 15 weight percent aqueous solvent, and about 15 to 25 weight percent humectant.

A preferred humectant is glycerine. A preferably aqueous solvent is water.

The sheet material can be dried and cut according to known processes to provide a provide suitable for use together with tobacco leaf forming a tobacco blend in a smoking article.

All scientific and technical terms used herein have meanings commonly used in the art unless otherwise specified. The definitions provided herein are to facilitate understanding of certain terms used frequently herein.

As used in this specification and the appended claims, the singular forms "a", "an", and "the" encompass embodiments having plural referents, unless the content clearly dictates otherwise.

As used in this specification and the appended claims, the term "or" is generally employed in its sense including "and/or" unless the content clearly dictates otherwise.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising," and the like.

Non-limiting examples illustrating certain aspects of the compositions, processes and articles described in this disclosure are provided below.

EXAMPLES

Example 1

The following steps were performed to form a first reconstituted sheet.

1. The selected flowers are frozen into freeze-dried form.
2. The freeze-dried flowers are macerated into a powder.
3. Glycerine and water are added to the flower powder.
4. The mix is added to tobacco powder to create a dough.
5. The dough is extruded into sheets.

The recipe for the dough is as follows:

| | Amount (in g) | Amount (in % weight) |
|---|---|---|
| Tobacco powder | 100.0 | ~58 |
| Flower powder | 16.0 | ~9 |
| Water | 23.0 | ~13 |
| Glycerine | 34.0 | ~19 |
| Total | 173.0 | |

Parameters of the single-screw extruder used to make the reconstituted sheet from the dough:

Screw speed: 50 rpm (revolutions/minute)

Sheet die: 10 mm width, 0.5 mm gap

Die temperature: 110° C.

Barrel temperature profile: 30/60/90° C.

Example 2

Another application of tobacco flowers to tobacco in slurry form for flavouring products are as follows:

1. The selected flowers are frozen into freeze-dried form.
2. The freeze-dried flowers are macerated into a powder.
3. Glycerine and water are added to the flower powder.
4. The mix is added to tobacco powder to create a slurry.
5. The slurry is heated to 90/100/120° C.
6. The slurry is made into reconstituted sheets.

The recipe for the slurry is as follows:

| | Amount (in g) | Amount (in %) |
|---|---|---|
| Tobacco powder | 100.0 | ~33 |
| Flower powder | 100.0 | ~33 |
| Water | 40.0 | ~13 |
| Glycerine | 60.0 | ~20 |
| Total | 300.0 | |

The invention claimed is:

1. A tobacco blend comprising:

cut tobacco; and a sheet material comprising tobacco and one or more flowers of *Nicotiana* species plant, the sheet material having at least 7 weight percent of the one or more flowers of *Nicotiana* species plant based on the total weight of the tobacco sheet material, wherein the one or more flowers of *Nicotiana* species plant is disposed on an outer surface of the sheet material.

2. The tobacco blend according to claim 1, wherein the flower of *Nicotiana* species plant is in particulate form or powder form.

3. The tobacco blend according to claim 1, wherein the sheet of tobacco comprises a reconstituted tobacco sheet.

4. The tobacco blend according to claim 1, wherein the *Nicotiana* species plant comprises a tobacco variety selected from Red Russian, K326, Lakson *N. rustica*, Kasturi, Kasturi Asep, Tombak, Basma Zihna, Basma Drama, or TI1112.

5. The tobacco blend according to claim 1, wherein the sheet of tobacco comprises about 10 to 40 weight percent flower of *Nicotiana* species plant, based on the total weight of the tobacco sheet material.

6. A tobacco blend according to claim 1, wherein the sheet material is cut.

7. A smoking article comprising the dried, cut tobacco blend according to claim 6.

8. A method comprising:

forming a sheet material comprising tobacco, the sheet material having an outer surface;

disposing one or more flowers of *Nicotiana* species plant on the outer surface of the sheet material and the sheet material having at least 7 weight percent of the one or more flowers of *Nicotiana* species plant based on the total weight of the tobacco sheet material.

9. The method according to claim 8 further comprising combining the sheet material with cut tobacco to form a tobacco blend.

10. The method according to claim 8 wherein the sheet material is formed by extruding or casting particulate tobacco.

11. The method according to claim 8 wherein the disposing step comprises disposing the one or more flowers of *Nicotiana* species plant having a particulate size in a range from about 25 to 200 micrometers on the tobacco sheet.

12. The method according to claim 8 wherein the forming step comprises blending one or more flowers of *Nicotiana* species plant in particulate form with particulate tobacco to form a particulate blend and forming the sheet material.

13. The method according to claim 8 wherein the one or more flowers of *Nicotiana* species plant is dried or freeze-dried prior to the disposing step.

14. The method according to claim 9 wherein the sheet of tobacco comprises at least about 5 weight percent flower of *Nicotiana* species plant, based on the total weight of the tobacco blend.

15. The method according to claim 8 wherein the forming step comprises blending:

50 to 65 weight percent particulate tobacco;

7 to 20 weight percent flower of *Nicotiana* species plant;

5 to 20 weight percent water; and 15 to 25 weight percent glycerin, all weights based on the total weight of the tobacco composition.

16. The method according to claim 8 wherein the forming step comprises blending:

25 to 40 weight percent particulate tobacco;

25 to 40 weight percent flower of *Nicotiana* species plant;

5 to 20 weight percent water; and 15 to 25 weight percent glycerin, all weights based on the total weight of the tobacco composition.

17. The tobacco blend according to claim 2, wherein the sheet of tobacco comprises a reconstituted tobacco sheet.

18. The tobacco blend according to claim 17, wherein the sheet of tobacco comprises about 7 to 40 weight percent flower of *Nicotiana* species plant, based on the total weight of the tobacco sheet.

19. The method according to claim 10 wherein the disposing step comprises disposing the one or more flowers of *Nicotiana* species plant having a particulate size in a range from about 25 to 200 micrometers on the tobacco sheet.

20. The method according to claim 19 wherein the forming step comprises blending one or more flowers of *Nicotiana* species plant in particulate form with particulate tobacco to form a particulate blend and forming the sheet material.

21. The tobacco blend according to claim 1, wherein the sheet material comprises a mixture of tobacco, one or more flowers of *Nicotiana* species plant, an aqueous solvent, and a humectant.

* * * * *